US006017282A

United States Patent [19]

Stefonsky

[11] Patent Number: 6,017,282

[45] Date of Patent: Jan. 25, 2000

[54] GOLF BALL POSITION MARKING SYSTEM

[76] Inventor: John A. Stefonsky, 7112 Northbridge Blvd., Tampa, Fla. 36615

[21] Appl. No.: 09/127,568

[22] Filed: Jul. 31, 1998

[51] Int. Cl.[7] ..... A63B 57/00

[52] U.S. Cl. ..... 473/406; 473/407

[58] Field of Search ..... 473/405, 406, 473/407, 285, 218; 224/918

[56] References Cited

U.S. PATENT DOCUMENTS

| | | | |
|---|---|---|---|
| 1,735,736 | 11/1929 | Davidson | 473/406 |
| 2,107,944 | 2/1938 | Howard | 473/406 |
| 3,041,071 | 6/1962 | Fialon | 473/406 |
| 5,282,616 | 2/1994 | Stacavich-Notaro | 473/406 |
| 5,356,133 | 10/1994 | Bellagamba | 473/406 |
| 5,364,094 | 11/1994 | Mustion | 473/406 |
| 5,437,446 | 8/1995 | Youngkin | 473/406 |
| 5,569,103 | 10/1996 | Sihn | 473/406 |
| 5,795,249 | 8/1998 | Johnson | 473/406 |

*Primary Examiner*—Steven Wong
*Attorney, Agent, or Firm*—Joseph N. Breaux

[57] ABSTRACT

A golf ball position marking system that includes a position marker for marking the location of a ball and repositioning aid including a reference position marker having a reference direction indicator, which also serves as a reminder that a player has moved the original ball mark. The golf ball position marker includes a grass spike. The reference position marker is storable within a compartment formed within the golf ball position marker and includes a resilient bevel sided marker member with a raised direction indicating arrow and a central grass spike passage aperture.

1 Claim, 2 Drawing Sheets

GOLF BALL POSITION MARKING SYSTEM

TECHNICAL FIELD

The present invention relates to golf accessories and more particularly to a golf ball position marking system that is used to mark the position of a golf ball when the position of the golf ball must be marked to allow a farther out player to shoot toward the hole; the golf ball marking system including a ball position marker and a moved-ball direction indicator marker, which (servers) as a reminder that the original mark was moved; the ball position marker including a rigid, opaque outer ring member and a transparent deflectable center member with a centrally positioned, downwardly depending grass spike extending through and past a direction marker storage chamber defined by the tapered internal wall of the rigid, opaque outer ring member and the underside surface of the center member and accessible through a direction marker insertion opening having a diameter less than the diameter of the center member, the center member being permanently secured in connection with the upper internal edge of the outer ring member; the ball direction indicator marker including a resilient bevel sided marker member with a raised direction indicating arrow and a central grass spike passage aperture, the bevel sided marker member having a top side diameter less than the diameter of the direction marker insertion opening and a bottom side diameter greater than the diameter of the direction marker insertion opening and less than the diameter of the center member; the central grass spike passage aperture being sized to allow passage therethrough of the grass spike.

BACKGROUND ART

In game of golf the player with the ball landing farthest from the hole has the option of shooting toward the hole before the other players. This can cause a problem when the balls are on the green and a closer ball lies near the path between the farther out ball and the hole. When this occurs, the player with the closer ball must move his ball and mark the location of the ball with a ball position marker. When the closer ball lies in the path between the farther out ball and the hole, the closer ball must be moved and a reference spot marked and a repositioning mechanism put in place for replacing the ball in the same position after the farther out ball has been shot. It would be a benefit, therefore, to have a system that could be used to mark the location of a ball and as a repositioning aid including a reference position marker having a reference direction indicator which also serves as a reminder that the original ball mark has been moved.

GENERAL SUMMARY DISCUSSION OF INVENTION

It is thus an object of the invention to provide a golf ball position marking system that includes a position marker for marking the location of a ball and repositioning aid including a reference position marker having a reference direction indicator which also serves as a reminder that the original ball mark has been moved.

It is a further object of the invention to provide a golf ball position marking system that includes a golf ball position marker and a ball direction indicator marker; the ball position marker including a rigid, opaque outer ring member and a transparent deflectable center member with a centrally positioned, downwardly depending grass spike extending through and past a direction marker storage chamber defined by the tapered internal wall of the rigid, opaque outer ring member and the underside surface of the center member and accessible through a direction marker insertion opening having a diameter less than the diameter of the center member, the center member being permanently secured in connection with the upper internal edge of the outer ring member; the ball direction indicator marker including a resilient bevel sided marker member with a raised direction indicating arrow and a central grass spike passage aperture, the bevel sided marker member having a top side diameter less than the diameter of the direction marker insertion opening and a bottom side diameter greater than the diameter of the direction marker insertion opening and less than the diameter of the center member; the central grass spike passage aperture being sized to allow passage therethrough of the grass spike.

Accordingly, a golf ball position marking system is provided. The golf ball marking system includes a ball position marker and a ball direction indicator marker; the ball position marker including a rigid, opaque outer ring member and a transparent deflectable center member with a centrally positioned, downwardly depending grass spike extending through and past a direction marker storage chamber defined by the tapered internal wall of the rigid, opaque outer ring member and the underside surface of the center member and accessible through a direction marker insertion opening having a diameter less than the diameter of the center member, the center member being permanently secured in connection with the upper internal edge of the outer ring member; the ball direction indicator marker including a resilient bevel sided marker member with a raised direction indicating arrow and a central grass spike passage aperture, the bevel sided marker member having a top side diameter less than the diameter of the direction marker insertion opening and a bottom side diameter greater than the diameter of the direction marker insertion opening and less than the diameter of the center member; the central grass spike passage aperture being sized to allow passage therethrough of the grass spike.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
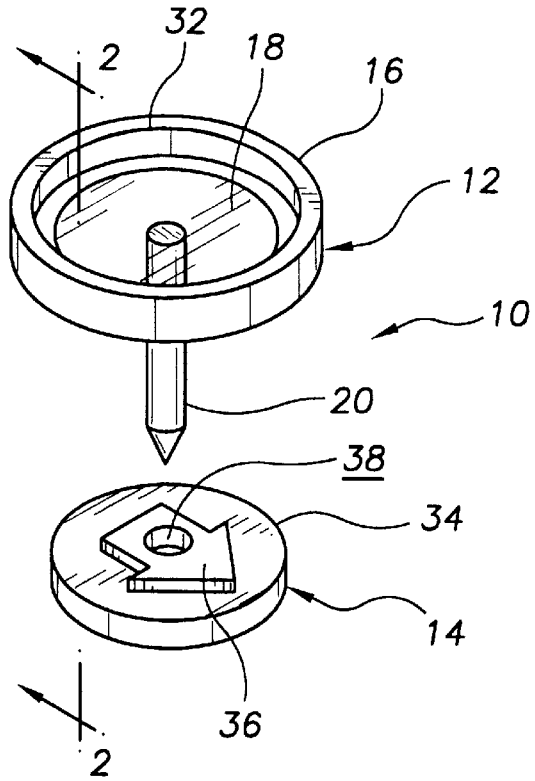
FIG. 1 is an exploded perspective view of an exemplary embodiment of the golf ball position marking system of the present invention showing the ball position marker including the opaque outer ring member and the transparent deflectable center member with the centrally positioned, downwardly depending grass spike and the ball direction indicator marker including the bevel sided marker member with the raised direction indicating arrow and the central grass spike passage aperture.

FIG. 1 shows an exemplary embodiment of the golf ball position marking system of the present invention generally designated by the numeral 10. Golf ball position marker system 10 includes a ball position marker, generally designated 12, and a ball direction indicator marker, generally designated 14.

Figure 2:
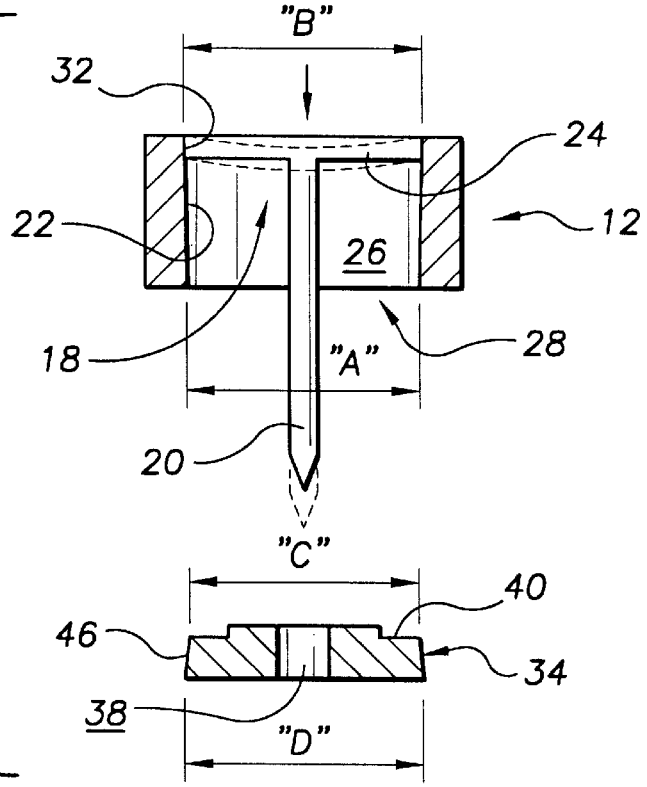
FIG. 2 is a sectional view of the exemplary golf ball position marking system of FIG. 1 along the line 2—2 showing the tapered opaque outer ring member with the smaller diameter direction marker insertion opening, the transparent deflectable center member with the centrally positioned grass spike, and the direction marker storage chamber of the ball position marker and the bevel sided marker with the raised direction indicating arrow and the central grass spike passage aperture of the ball direction indicator marker.

Golf ball position marker 12 includes an opaque white, rigid plastic outer ring member 16 and a transparent, deflectable center ember 18 with a centrally positioned, downwardly depending grass spike 20. With reference to FIG. 2, outer ring member 12 has a tapered inner wall 22 that along with an underside surface 24 of center member 18 defines a direction marker storage chamber 26. Direction marker storage chamber 26 is accessible through a smaller diameter direction marker insertion opening 28 having a first diameter "A" of fourteen sixteenths of an inch (14/16). Center member 18 has a second diameter "B" of fifteen sixteenths of an inch (15/16") and a thickness of 1/32". Center member 18 is adhesively cemented to an upper internal edge 32 (see also FIG. 1) of outer ring member 12, and is 3/32" in length.

Figure 3:
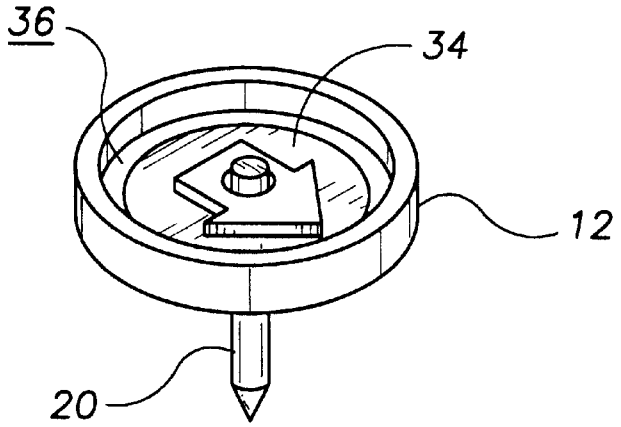
FIG. 3 is a perspective view showing the ball direction indicator marker positioned within the direction marker storage chamber and the centrally positioned grass spike inserted through the central grass spike passage aperture of the bevel sided marker member.

Referring back to FIG. 1, ball direction indicator marker 14 is of molded, resilient plastic construction and includes a bevel sided marker 34 with a raised direction indicating arrow 36 which is 3/4" long and raised 1/64" and a central grass spike passage aperture 38. With reference back to FIG. 2, resilient bevel sided marker member 34 has a top side diameter "C" of twenty-seven thirty-seconds of an inch (27/32") and a bottom side diameter "D" of twenty-nine thirty-seconds of an inch (29/32") and is 1/16" from raised arrow to other side of piece. As grass spike 20 which is 3/8" long and 1/16" wide is inserted through central grass spike passage aperture 38, top surface 40 of resilient bevel sided marker member 34 passes through direction marker insertion opening 28. As resilient bevel sided marker member 34 continues to pass through direction marker insertion opening 28, beveled sidewall 46 contacts tapered inner wall 22 of ball marker member 12 slightly compressing resilient bevel sided marker member 34 and generating a gripping force therebetween for holding resilient bevel sided marker member 34 within direction marker storage chamber 26. Grass spike 20 is sized to pass through central grass spike passage aperture 38 a sufficient distance to allow resilient bevel sided marker member 34 to be positioned within direction marker storage chamber 26 as shown in FIG. 3. Referring back to FIG. 2, center member 18 is deflectable into direction marker storage chamber 26 a distance sufficient to contact top surface 40 and force resilient bevel sided marker member 34 out of direction marker storage chamber 26.

Figure 4:
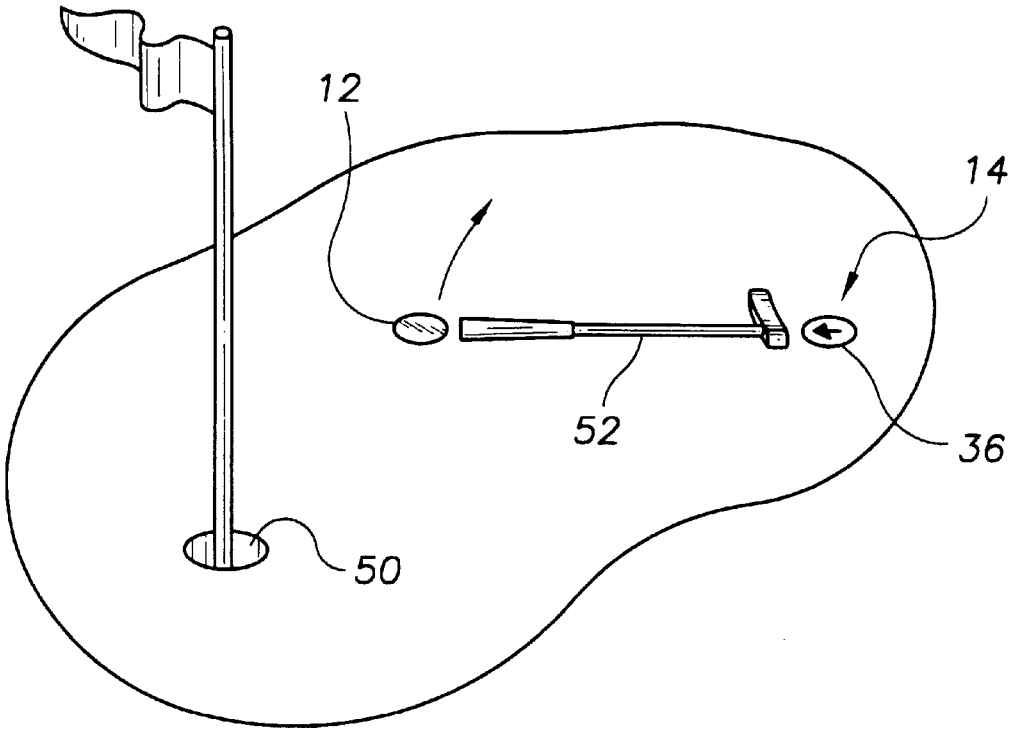
FIG. 4 is a perspective view of a representative golf green showing the golf ball position marking system of FIG. 1 in use with the ball position marker positioned in place of the ball, the putter positioned between the ball position marker and the ball direction indicator marker, and the raised ball direction indicator marker positioned at the other end of the putter with the raised direction indicating arrow aimed in the direction of ball position marker prior to lifting the ball position marker and the putter.

With reference to FIG. 4, in use, ball marker 12 is used to mark the position of a ball. Should the ball be in the path between a farther out ball and the hole 50, a putter head is laid between ball position marker 12 and ball direction indicator marker 14 and the raised ball direction indicator arrow 36 aimed in the direction of ball position marker 12. Ball position marker 12 and the putter head 52 are then removed to allow the farther out player to play through. The ball is then replaced by laying putter head 52 down adjacent to ball direction indicator marker 14 in the direction indicated by raised ball direction indicator arrow 36 and positioning the ball adjacent to the other end of putter head 52. Ball direction indicator marker 14 is then lifted and positioned back into direction marker storage chamber 26 (FIG. 2) as previously described.

It can be seen from the preceding description that a golf ball position marking system has been provided that includes a position marker for marking the location of a ball and repositioning aid including a reference position marker having a reference direction indicator; and that includes a golf ball position marker and a ball direction indicator marker, which also serves as a reminder that the original ball mark has been moved; the ball position marker including a rigid, opaque outer ring member and a transparent deflectable center member with a centrally positioned, downwardly depending grass spike extending through and past a direction marker storage chamber defined by the tapered internal wall of the rigid, opaque outer ring member and the underside surface of the center member and accessible through a direction marker insertion opening having a diameter less than the diameter of the center member, the center member being permanently secured in connection with the upper internal edge of the outer ring member; the ball direction indicator marker including a resilient bevel sided marker member with a raised direction indicating arrow and a central grass spike passage aperture, the bevel sided marker member having a top side diameter less than the diameter of the direction marker insertion opening and a bottom side diameter greater than the diameter of the direction marker insertion opening and less than the diameter of the center member; the central grass spike passage aperture being sized to allow passage therethrough of the grass spike.

It is noted that the embodiment of the golf ball position marking and moved ball reminder system described herein in detail for exemplary purposes is of course subject to many different variations in structure, design, application and methodology. Because many varying and different embodiments may be made within the scope of the inventive concept (s) herein taught, and because many modifications may be made in the embodiment herein detailed in accordance with the descriptive requirements of the law, it is to be understood that the details herein are to be interpreted as illustrative and not in a limiting sense.

What is claimed is:

1. A golf ball position marking system comprising:

a ball position marker; and a ball direction indicator marker for functioning as a reminder that said ball position marker has been moved;

said ball position marker including a rigid, opaque outer ring member and a transparent deflectable center member with a centrally positioned, downwardly depending grass spike extending through and past a direction marker storage chamber defined by a tapered internal wall of said rigid, opaque outer ring member and an underside surface of said center member, said direction marker storage chamber being accessible through a direction marker insertion opening having a first diameter less than a second diameter of said center member;

said center member being permanently secured in connection with an upper internal edge of said outer ring member;

said ball direction indicator marker including a resilient bevel sided marker member with a raised direction indicating arrow and a central grass spike passage aperture, said bevel sided marker member having a top side diameter less than said first diameter of said direction marker insertion opening and a bottom side diameter greater than said first diameter of said direction marker insertion opening and less than said second diameter of said center member;

said central grass spike passage aperture being sized to allow passage therethrough of said grass spike.

* * * * *